US012239253B2

(12) United States Patent
Siljestroem

(10) Patent No.: US 12,239,253 B2
(45) Date of Patent: Mar. 4, 2025

(54) TRAVEL BLANKET FOLDING KIT

(71) Applicant: Andreas Siljestroem, West Palm Beach, FL (US)

(72) Inventor: Andreas Siljestroem, West Palm Beach, FL (US)

(73) Assignee: Proglobe EC LLC, Lake Worth Beach, FL (US)

( * ) Notice: Subject to any disclaimer, the term of this patent is extended or adjusted under 35 U.S.C. 154(b) by 315 days.

(21) Appl. No.: 17/657,445

(22) Filed: Mar. 31, 2022

(65) Prior Publication Data

US 2023/0312148 A1 Oct. 5, 2023

(51) Int. Cl.

| | |
|---|---|
| ***A47G 9/02*** | (2006.01) |
| ***A47C 7/38*** | (2006.01) |
| ***A47G 9/10*** | (2006.01) |
| ***B65B 5/06*** | (2006.01) |

(52) U.S. Cl.

CPC ..... *A47G 9/0223* (2013.01); *A47C 7/383* (2013.01); *A47G 9/1045* (2013.01); *B65B 5/067* (2013.01)

(58) Field of Classification Search

CPC .. A47G 9/0223; A47G 9/0261; A47G 9/1045; A47G 9/10; A47G 9/1009; A47G 9/1027; A47G 9/1054; A47G 9/1063; A47G 9/1072; A47G 9/1081; A47G 9/109; A47G 2009/1018; A47C 7/383; B65B 5/067

See application file for complete search history.

(56) References Cited

U.S. PATENT DOCUMENTS

| | | | | |
|---|---|---|---|---|
| 5,481,767 | A | 1/1996 | Lewis | |
| 5,737,785 | A * | 4/1998 | Casey | A45F 4/02 5/419 |
| 6,367,083 | B1 * | 4/2002 | November | A47G 9/064 5/413 R |
| 6,851,127 | B1 | 2/2005 | Khan | |
| 8,256,045 | B2 * | 9/2012 | Cruz | A45C 9/00 5/419 |
| 9,968,205 | B1 * | 5/2018 | Gaudyn | A47G 9/0246 |
| 10,869,566 | B2 | 12/2020 | Kassab Arabo | |
| 10,966,553 | B1 * | 4/2021 | Wilson-Brown | A47G 9/1045 |
| 2002/0088830 | A1 * | 7/2002 | Rose | A45C 15/00 224/652 |
| 2005/0039261 | A1 | 2/2005 | Corral | |
| 2005/0262634 | A1 * | 12/2005 | Gottlieb | A45F 4/06 5/482 |
| 2010/0059558 | A1 * | 3/2010 | Robinson | A47G 9/066 2/88 |
| 2011/0030140 | A1 * | 2/2011 | Ruiz | A47G 9/02 224/259 |
| 2011/0042428 | A1 | 2/2011 | Ranciato | |
| 2011/0233252 | A1 | 9/2011 | Warren | |

(Continued)

*Primary Examiner* — George Sun

(74) *Attorney, Agent, or Firm* — Dunlap Bennett & Ludwig, PLLC

(57) ABSTRACT

A travelling kit for storing travel accessories in a travel bag, wherein the travel bag is transformable to a travel blanket. The travel blanket, in a planar, flat condition, circumscribes a cover portion defined by perimetral joining edges adjacent an interface of the travel blanket and the cover portion. The travel portion is foldable around a neck pillow and other travel accessories so that when the cover portion is folded in half, the resulting adjacent perimetral joining edges can be joined to form the travel bag that encloses the travel accessories.

14 Claims, 8 Drawing Sheets

(56) References Cited

U.S. PATENT DOCUMENTS

| | | | | |
|---|---|---|---|---|
| 2012/0167304 | A1* | 7/2012 | Keller | A63H 33/18 5/485 |
| 2013/0001262 | A1 | 1/2013 | Razavi | |
| 2014/0041091 | A1* | 2/2014 | Sternlight | A61F 9/04 2/12 |
| 2017/0224033 | A1* | 8/2017 | Latta, Jr. | A47G 9/1045 |
| 2018/0177312 | A1* | 6/2018 | Reed-Williams | A47G 9/1045 |
| 2018/0263389 | A1* | 9/2018 | Lee | A47G 9/0223 |
| 2018/0325292 | A1* | 11/2018 | Kassab Arabo | A47C 7/383 |
| 2019/0021475 | A1 | 1/2019 | Lindenmeyer et al. | |
| 2019/0246712 | A1* | 8/2019 | Sonksen | A47G 9/064 |
| 2019/0269229 | A1* | 9/2019 | Rosenblum | A47G 9/0223 |
| 2020/0128980 | A1* | 4/2020 | Hanifi | A47G 9/1081 |
| 2021/0244163 | A1* | 8/2021 | Ware | A47G 9/0223 |
| 2021/0267332 | A1* | 9/2021 | Gies | A47C 7/386 |
| 2021/0337970 | A1* | 11/2021 | Fan | A47G 9/1081 |
| 2021/0353083 | A1 | 11/2021 | Ali | |
| 2022/0061557 | A1* | 3/2022 | Cordani | A47G 9/0253 |

* cited by examiner

TRAVEL BLANKET FOLDING KIT

BACKGROUND OF THE INVENTION

The present invention relates to traveling accessories and, more particularly, a travel blanket folding kit.

Many travelers require certain accessories, such as a neck pillow, a travel blanket, an eye mask, ear plugs, and/or the like. When traveling with such travel accessories, it can be a challenge to keep all these disparate accessories organized and together during a trip that may include several modes of travel and last days if not weeks. Unfortunately, when disparate accessories become separated, they can more easily be lost or forgotten during a trip. Additionally, these different accessories are differently, complementarily shaped and constructed, and so take up a lot of space in one's traveling bag. This probably explains while no other travel blanket kit has been able to include the neck pillow, eye mask and ear plugs in an efficient and organized manner in one traveling bag.

As can be seen, there is a need for a travel blanket folding kit that solves the problem of traveling with disparate, disconnected, and seemingly incompatible, uncomplimentary travel components by way of transforming the travel blanket into a bag that carries the neck pillow, the eye mask, and the ear plugs. The present invention also solves the problem of luggage space allocation since a user can attach the folded-up travel blanket/carry bag to a carry on, backpack, or other travel bag, thereby freeing up space for other travel gear.

The present invention is one set or kit wherein the neck pillow, eye mask and earplugs can be included in the travel blanket and become one unit.

SUMMARY OF THE INVENTION

In one aspect of the present invention, a travelling kit apparatus providing the following: a cover portion having a generally rectangular configuration; a joining edge disposed along substantially an entirety of a periphery of the cover portion; a joining slider operatively associated with the joining edge; a sheet portion generally circumscribing the cover portion, wherein a flat condition, the sheet portion is coplanar as it extends from the entirety of the periphery of the cover portion, and wherein the joining edge is out of plane with the sheet portion so as to be adjacent only one side thereof; and wherein in a folded condition the joining slider is configured to join opposing portions of the joining edge that are adjacent to each other.

In another aspect of the present invention, the travelling kit apparatus further provides, wherein the folded condition has a fold line that divides the cover portion in two generally equal halves, wherein the sheet portion is foldable to lie within the entirety of the periphery of the cover portion so that joining the entirety of the periphery of the cover portion encloses the sheet portion therein; and further providing a strap extending between the joining slider and an opposing portion of the periphery of the cover portion in the flat condition, wherein the cover portion is made of a first material, and wherein the sheet portion is made of a second material, wherein the first material is a plasticized material, and wherein the sheet portion is made of a plush material; and further providing (in certain embodiment) a U-shaped void communicating with a periphery of the sheet portion, wherein the U-shaped void is spaced apart the cover portion.

In yet another aspect of the present invention, a method of complementarily storing a travel blanket and a neck pillow includes the following: laying the above mentioned apparatus in its flat condition; tri-folding the sheet portion so that its width is generally coextensive with a width of the cover portion; placing the neck pillow on another side of the cover portion opposite said one side, within the entirety of the periphery of the cover portion; rolling or folding each longitudinal end of the tri-folded sheet portion toward the neck pillow; wrapping both longitudinal ends over the neck pillow so as to form the folded condition; and engaging the entirety of the periphery of the cover portion via the joining slide to enclose the neck pillow and the sheet portion therein, wherein the neck pillow is enclosed in a cylindrical pouch, wherein the cylindrical pouch as a longitudinal equal to or less than the width of the cover portion, wherein a face mask and a pair of earplugs are also enclosed by the sheet portion.

These and other features, aspects and advantages of the present invention will become better understood with reference to the following drawings, description, and claims.

DETAILED DESCRIPTION OF THE INVENTION

Figure 1:
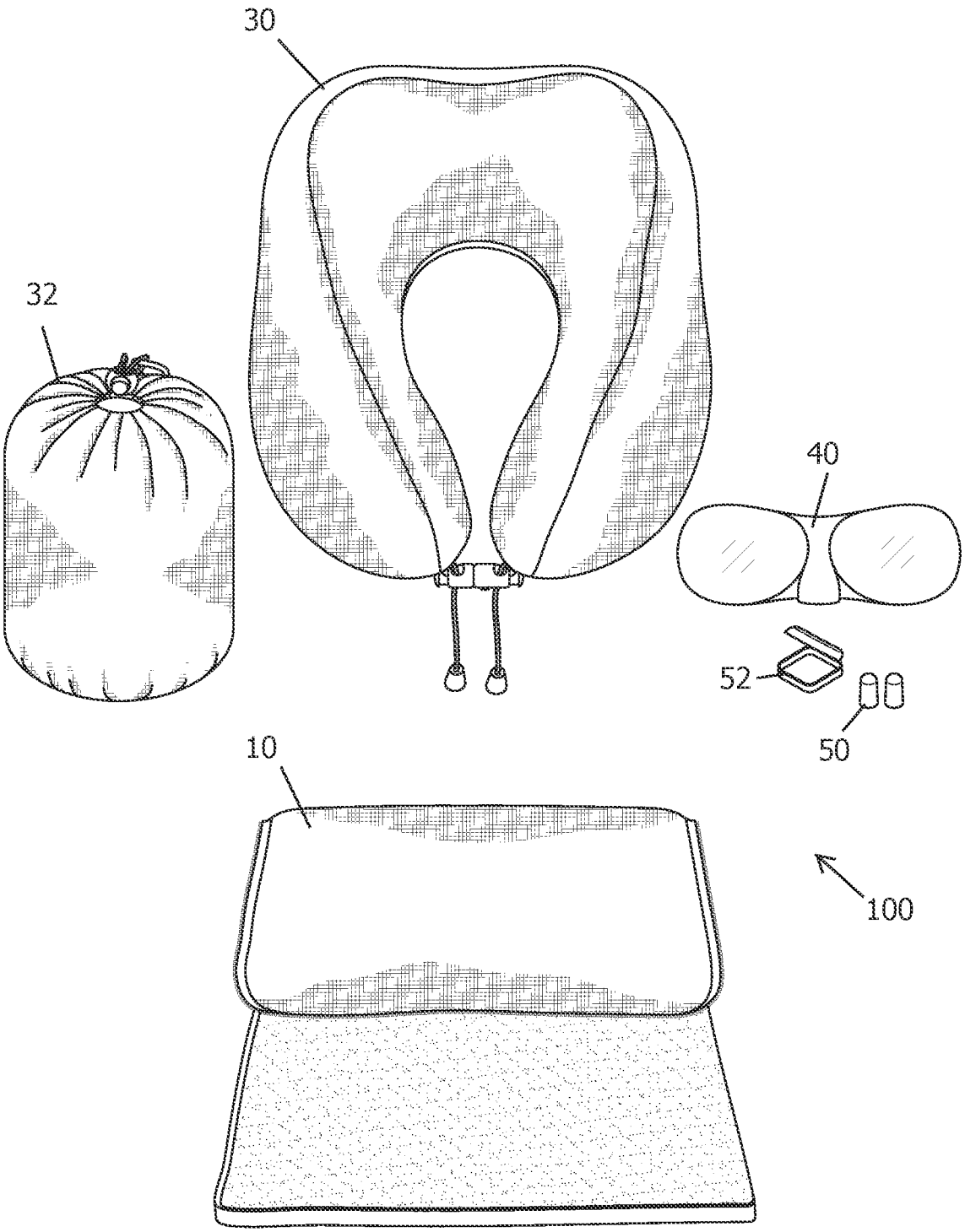
FIG. 1 is a top perspective view of an exemplary embodiment of the present invention, illustrating a kit in an unassembled or unpacked condition.
Figure 2:
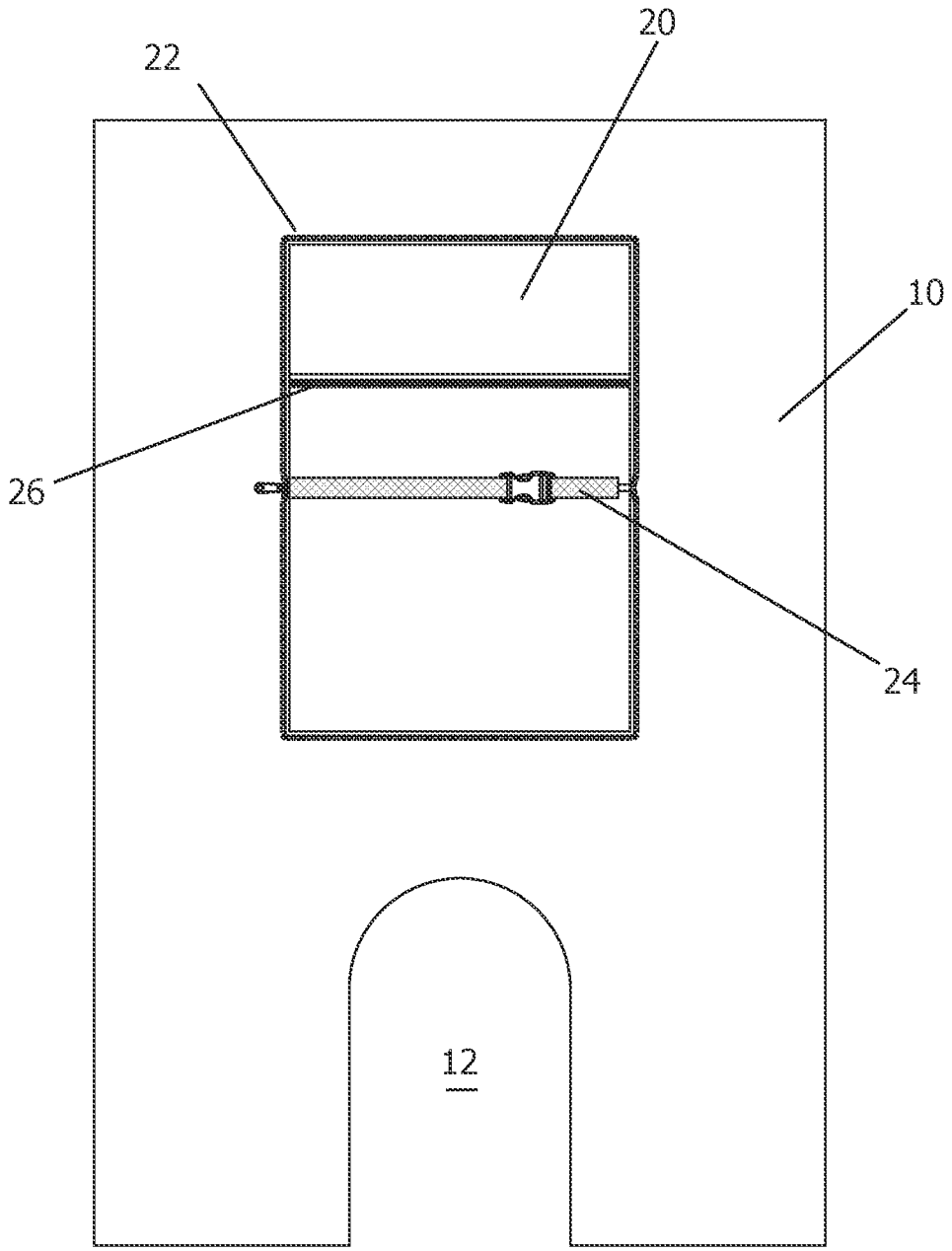
FIG. 2 is a top plan view of an exemplary embodiment of a travel blanket of the present invention.
Figure 3:
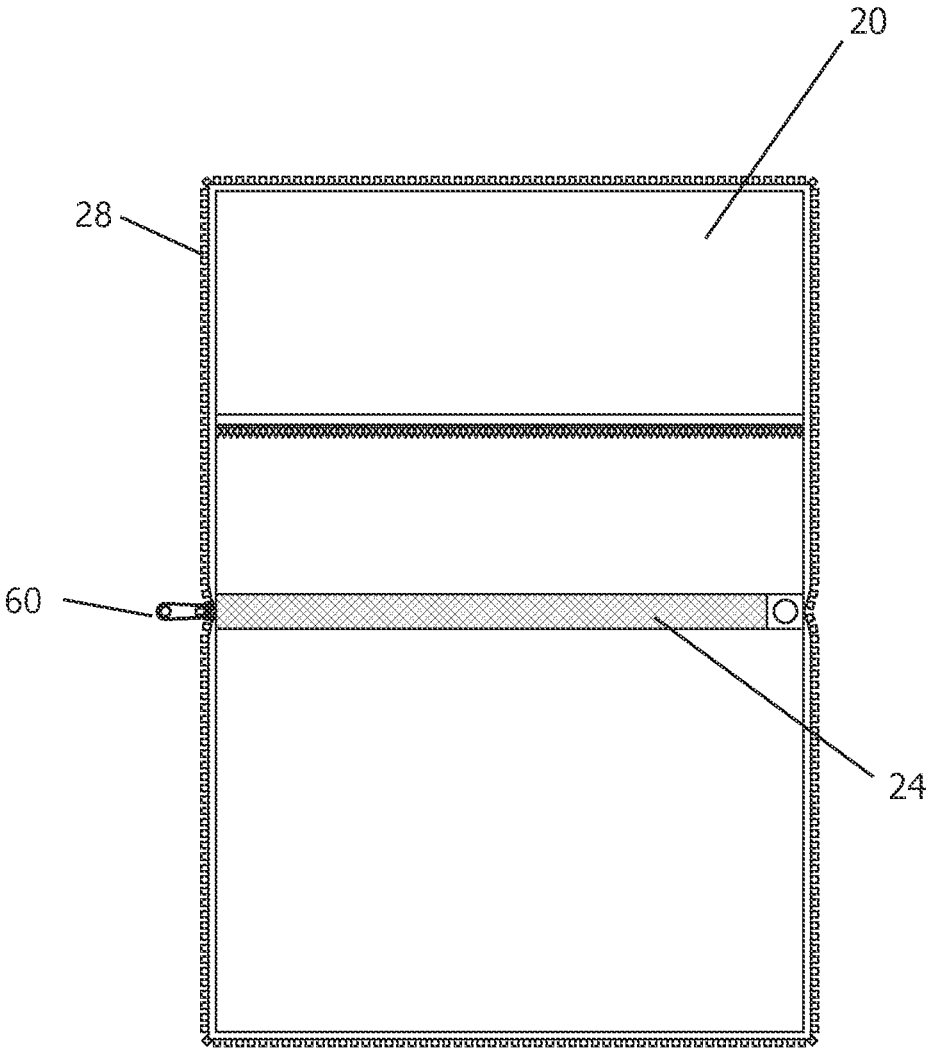
FIG. 3 is a detail top plan view of an exemplary embodiment of a bag portion of the travel blanket of the present invention.
Figure 4:
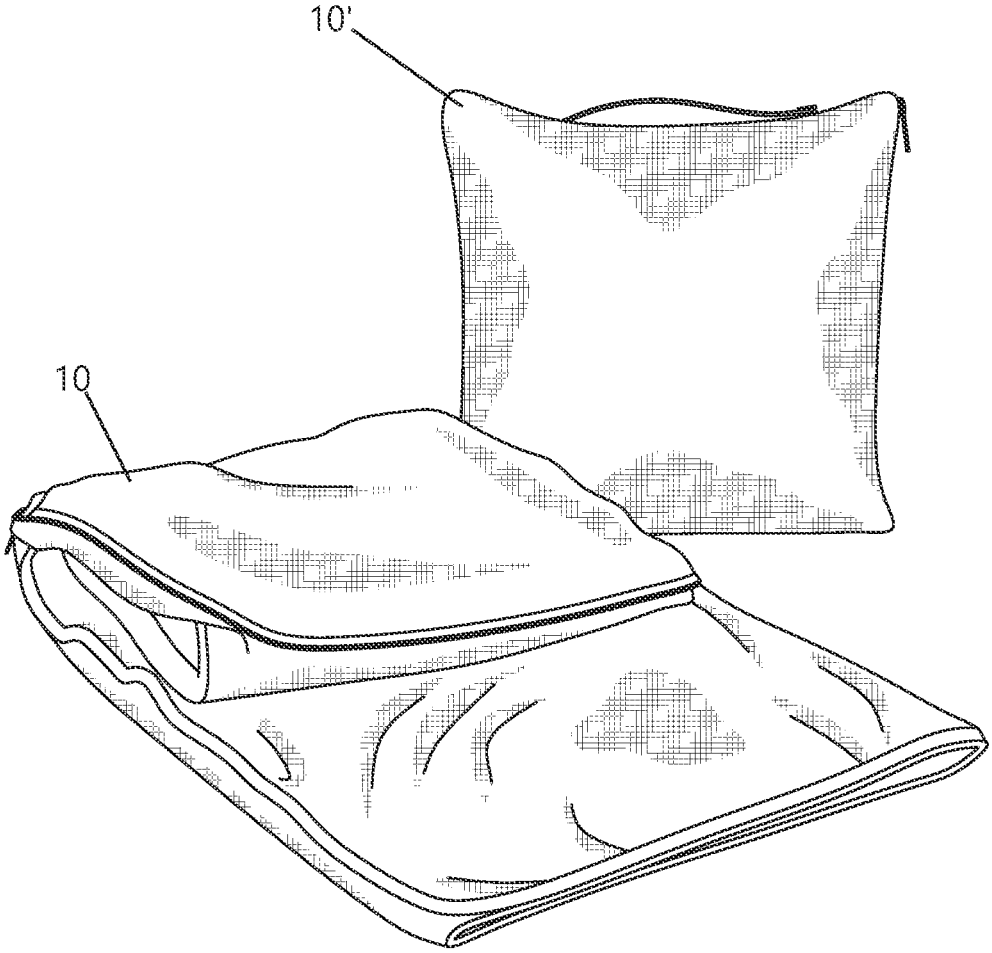
FIG. 4 is a top perspective view of an exemplary embodiment of the present invention, showing two travel blankets: one in the background in a carry bag condition, and one in the foreground in a folded or semi-folded condition.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a travelling kit for storing travel accessories in a travel bag, wherein the travel bag is transformable to a travel blanket. The travel blanket, in a planar, flat condition, circumscribes a cover portion defined by perimetral joining edges adjacent an interface of the travel blanket and the cover portion. The travel portion is foldable around a neck pillow and other travel accessories so that when the cover portion is folded in half, the resulting adjacent perimetral joining edges can be joined to form the travel bag that encloses the travel accessories.

Referring now to FIGS. 1 through 8, the present invention may include a traveling kit 100. The traveling kit 100 may include a neck pillow 30 with its own separate pouch 32, an eye mask 40, and a set of ear plugs 50 and a container 52 for the ear plugs 50. The traveling kit 100 includes a travel blanket 10 that is adapted to transform into a carry bag 10' that encloses all of the other travel accessories of the kit 100. The traveling kit 100 may include additional travel accessories beyond the ones shown in the illustrations. It is also contemplated that the traveling kit 100, in certain embodiments, may container fewer that the shown accessories.

The travel blanket 10 may be generally rectangular. In certain embodiments a U-shaped portion 12 may be formed along a peripheral edge of the travel blanker 10. The U-shaped portion 12 may be a cutout or void in the travel blanket 10, which is dimensioned and adapted so that the travel blanket 10 may be engaged over a user's shoulders without having to have it over their head. The U-shaped portion 12 enables the travel blanket 10 to be wearable so it does not contact the head or face region of the user, which could be advantageous for users who do not want to mess up their make-up while using the travel blanket 10 to sleep A cover portion 20 may be circumscribed by the travel blanked 10 when both are in a planar, flat condition. A joining edge 28 may be attached along the entire or substantially the entire periphery of the cover portion 20. This perimetral joining edge 28 may be row of teeth for a detachable fastener 22. The perimetral detachable fastener 22 enables the travel blanket 10 to transform or be reconfigured into the carrying bag 10' that can accommodate the neck pillow 30, the eye mask 40, and a set of ear plugs 50, the ear plug container 52, as well as other accessories, enclosed therein.

A method of using the present invention may include the following. In step one, the neck pillow 30 is folded and placed in its separate pouch 32.

In step two, the user may trifold the travel blanket 10 lengthwise into "thirds".

Figure 8:
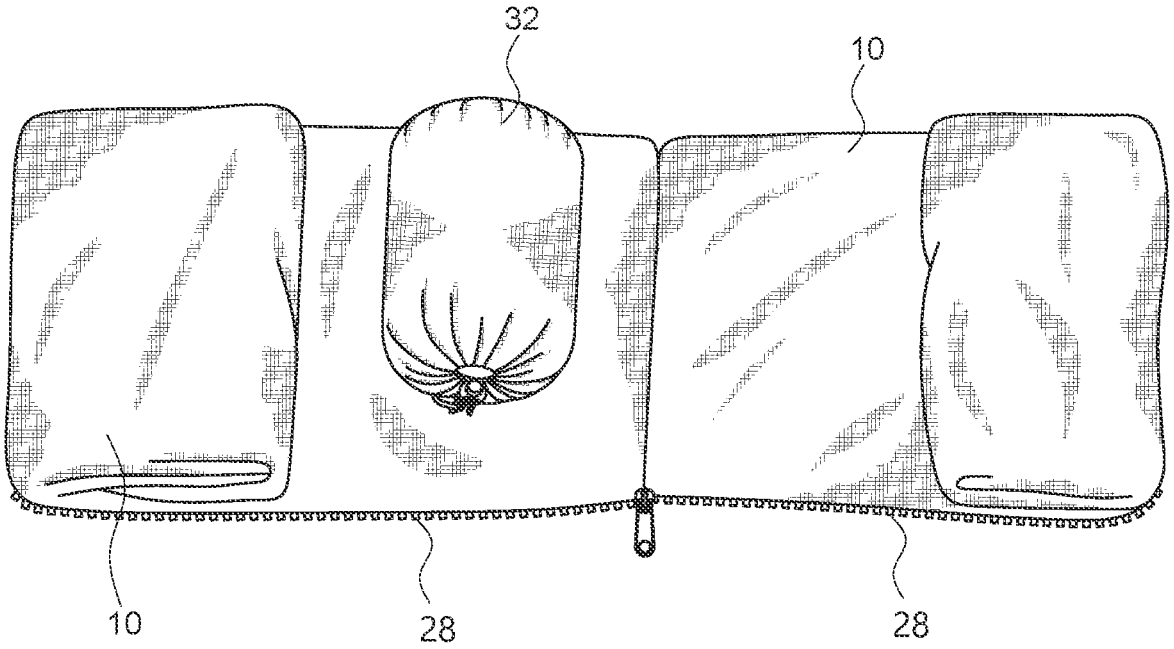
FIG. 8 is a top perspective view of an exemplary embodiment of the present invention, showing the travel blanket, tri-folded, with both ends folded adjacent to the pouch neck pillow 32' in an intermediate folded, pre-wrapped condition. The longitudinal axis of the travel blanket 10 runs left to right in this Figure.

Step three is folding, widthwise, the "in-thirds" blanket 10 adjacent to the pouched neck pillow 32' so that the resulting width of the travel blanket 10 is coextensive with the cover portion 20 (or area defined by the perimetral joining edges 22). This results in an intermediate folded condition (also known as pre-wrapped condition), as shown in FIG. 8, wherein the width is in a direction perpendicular to the longitudinal direction shared by the travel blanket/sheet portion 10 and the cover portion 20. In other words, in the intermediate folded condition, the longitudinal length of the folded travel blanket 10 is generally coaxial with that of the longitudinal length of the cover portion 20.

Figure 5:
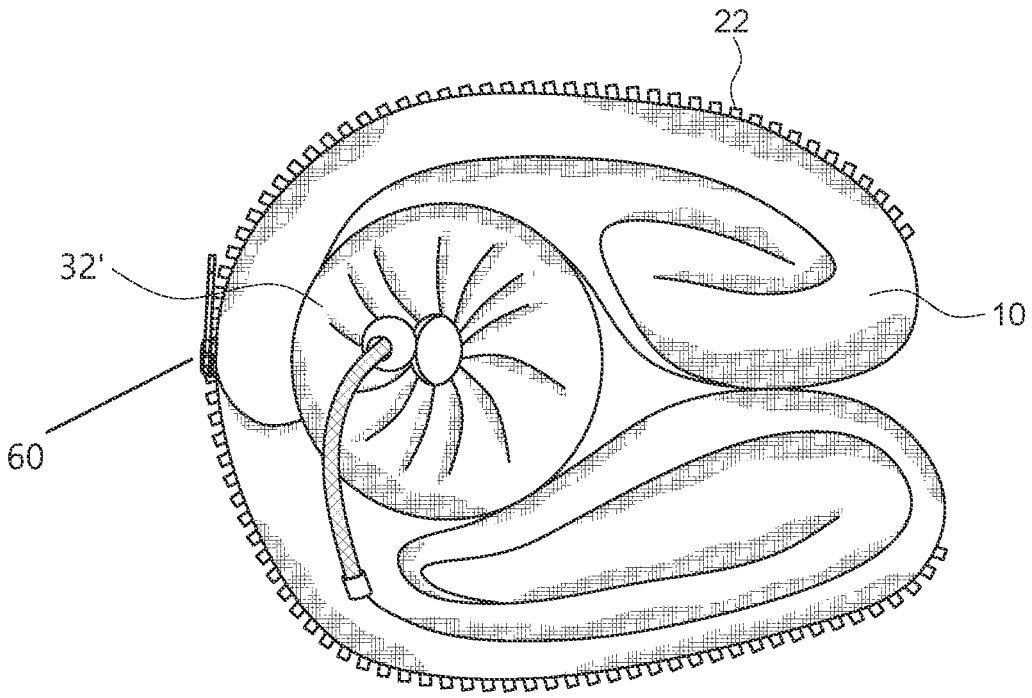
FIG. 5 is a side elevation view of an exemplary embodiment of the present invention showing the travel blanket folded around the cylindrical neck pouch in a wrapped condition.
Figure 6:
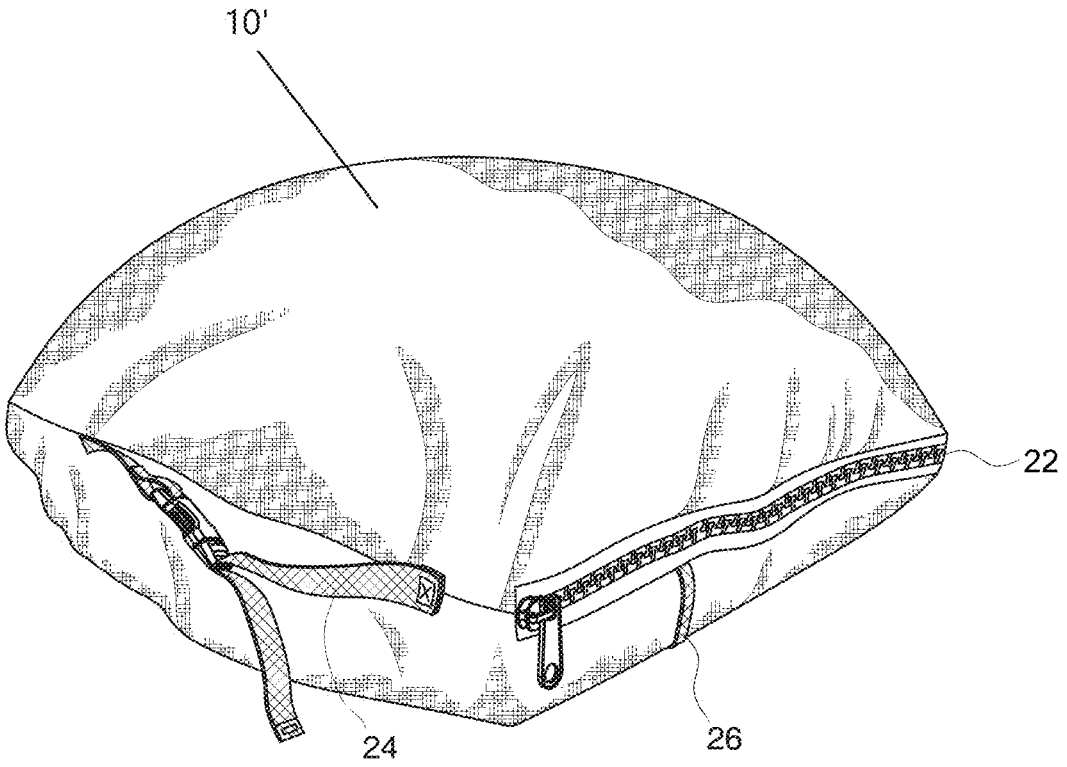
FIG. 6 is a top perspective view of an exemplary embodiment of the present invention, illustrating the kit in an assembled or packed condition.

In step four, the intermediate folded condition is folded in half to the folded condition with the pouched neck pillow 32' in a wrapped condition, wherein the longitudinal ends are wrapped thereabout, as illustrated in FIG. 5.

In step five, in the folded condition, the cover portion 20 is also folded in half, and as a result two rows of perimetral joining edges 28 are sufficiently adjacent to simultaneously be engaged by the joining slider 60. The joining slider 60 is designed to interlock/mesh and thereby join the two rows/portions of the joining edge 28 along a path defined by the joining edge 28, resulting in the formation of, reconfiguration of, transformation of the travel blanket 10 into the carry bag 10' enclosing the pouched neck pillow 32' and any other accessories that were disposed on or engaged with an upper side of the travel blanket in the intermediate folded condition.

It should be understood that the perimetral detachable fastener 22 need not be a zipper with zipper teeth as the joining edges 28 but may be any joining assembly that joins two edges together by way of a closure mechanism, such as a slider but not limited thereto.

To make the present invention, in some embodiments, a manufacturer may make the rectangular cover portion 20 of different material (such as a plasticized or otherwise waterproof material that becomes the outside of the carry bag 10') in the middle of a softer material (conducive for a blanket, such as but not limited to fleece) for the remaining portion of the travel blanket 10. This rectangular cover portion 20 may be defined by the perimetral detachable fastener 22 or the perimetral detachable fastener 22 may be attached along the periphery of the cover portion 20. Spanning the rectangular cover portion 20 (in certain embodiments, may be a click-on strap 24 which can be used to attach the carry bag 10' to luggage. The cover portion 20 may also have a small pocket 26, where one may place the eye mask 40, ear plugs 50 or other accessories when the kit 100 is in carry bag mode. The rectangular shaped (plasticized material) cover portion 20 becomes the exterior of the carry bag 10'.

The neck pillows pouch 32 may be specially designed in a cylindrical shape, whereby the length of the resulting cylindrical pouched neck pillow 32' complements the rectangular shape of the cover portion 20, facilitating moving the travel blanket 10 from its intermediate folded condition through to its folded condition.

Figure 7:
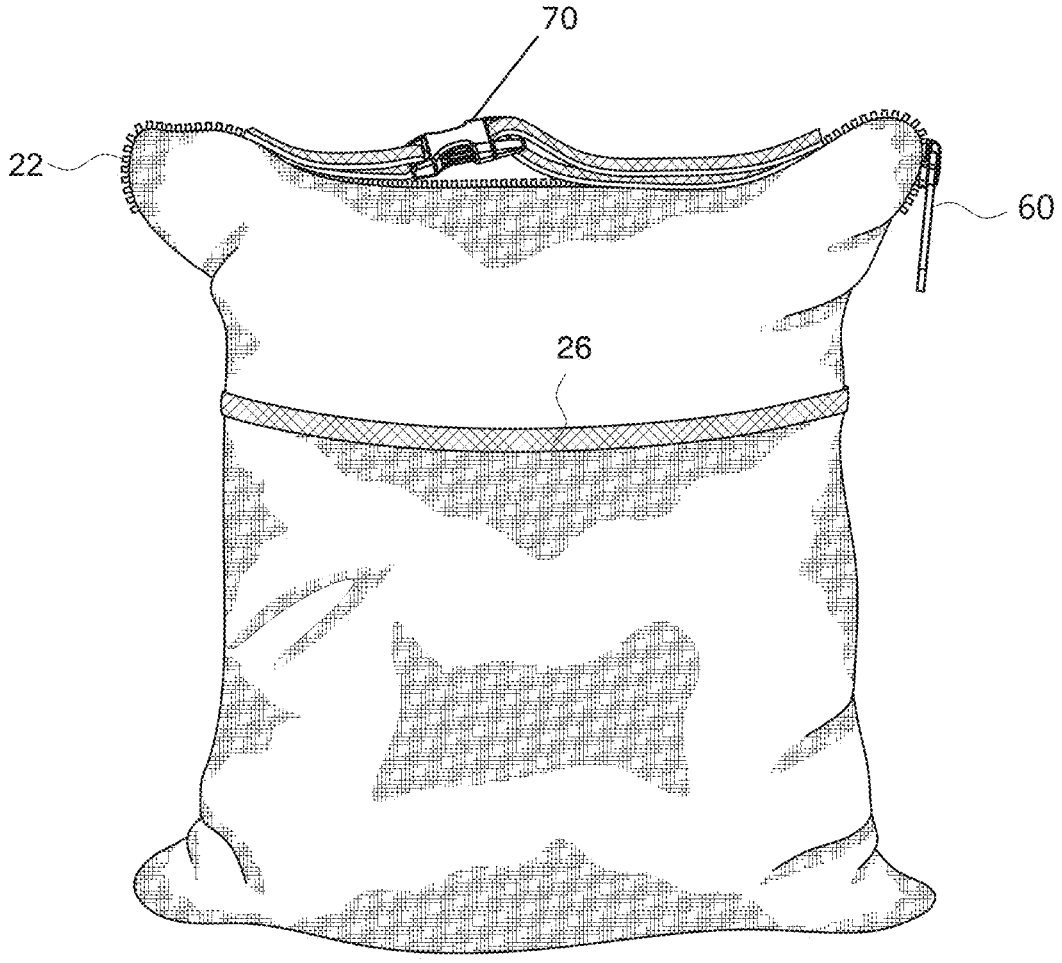
FIG. 7 is a side elevation view of an exemplary embodiment of the present invention, illustrating the kit in an assembled or packed condition.

Referring the FIG. 7, a clip 70 on the travel blanket 10 is configured to be disposed along the top of the carry bag 10'. The clip 70 enables attachment of the travel blanket 10/carry bag 10' to suitcases, bags, and the like.

A user of a provided travel kit 100 would solve the problem of carrying everything separately, noncomplementary accessories through the folding and unfolding process of the travel blanket 10 to the and from the carry bag 10'.

As used in this application, the term "about" or "approximately" refers to a range of values within plus or minus 10% of the specified number. And the term "substantially" or "generally" refers to 95% or more of an entirety. Recitation of ranges of values herein are not intended to be limiting, referring instead individually to any and all values falling within the range, unless otherwise indicated, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described embodiments. The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A kit for organizing a travel blanket, a U-shaped neck pillow, and a pair of ear plugs, comprising:

the travel blanket comprises: a cover portion having a generally rectangular shape;

a pocket provided within the cover portion;

a joining edge disposed along substantially an entirety of a periphery of the cover portion;

a joining slider operatively associated with the joining edge by way of a detachable fastener;

a sheet portion extends from the entirety of the periphery of the cover portion so that in a flat condition the sheet portion and the cover portion are coplanar while the joining edge is out of plane with the sheet portion;

and wherein in a folded condition the joining slider is configured to join opposing portions of the joining edge that are adjacent to each other, whereby Joining the opposing portions of the joining edge by way of the joining slider forms a carry bag configuration with the pocket accessible along an exterior surface of the carry bag configuration for retaining the pair of ear plugs therein;

and a neck pouch configured to house the U-shaped neck pillow while the neck pouch takes on a cylindrical shape, whereby a length of the cylindrical shape complements a width of the rectangular of the cover portion in the carry bag configuration, thereby facilitating moving the travel blanket from the folded condition to the carry bag configuration.

2. The kit of claim 1, wherein the folded condition has a fold line that divides the cover portion in two generally equal halves.

3. The kit of claim 2, wherein the sheet portion is foldable to lie within the entirety of the periphery of the cover portion so that joining the entirety of the periphery of the cover portion encloses the sheet portion therein.

4. The kit of claim 3, further comprising a strap having two ends that directly connect to two opposing portions, respectively, of the periphery of the cover portion in the flat condition, and wherein the strap is adjacent the fold line.

5. The kit of claim 4, wherein the cover portion is made of a first material, and wherein the sheet portion is made of a second material.

6. The kit of claim 5, wherein the first material is a plasticized material, and wherein the sheet portion is made of a plush material.

7. The kit of claim 6, further comprising a U-shaped void communicating with a periphery of the sheet portion, wherein the U-shaped void is spaced apart the cover portion.

8. A method of complementarily storing a travel blanket and a neck pillow, the method comprising:

laying the travel blanket of the kit of claim 4 in its flat condition;

tri-folding the sheet portion so that its width is generally coextensive with a width of the cover portion;

placing the U-shaped neck pillow in the neck pouch so that the latter defines the cylindrical shape, and then placing the neck pouch on another side of the cover portion opposite one side, within the entirety of the periphery of the cover portion;

rolling or folding each longitudinal end of the tri-folded sheet portion toward the neck pouch;

wrapping both longitudinal ends over the neck pouch so as to form the folded condition; and engaging the entirety of the periphery of the cover portion via the joining slide to enclose the neck pouch and the sheet portion therein, thereby forming a carry bag configuration.

9. The method of claim 8, wherein the cylindrical shape has a longitudinal equal to or less than the width of the cover portion.

10. The method of claim 9, further hanging the carry bag configuration from an object by way of a strap.

11. The kit of claim 1, the pocket having an opening along the exterior surface of the carry bag configuration so that the opening is accessible from an exterior environment.

12. The kit of claim 11, wherein the opening, in the flat condition, extends an entirety of said width of the rectangular of the cover portion.

13. The kit of claim 12, wherein the joining edge is a detachable fastener.

14. The kit of claim 13, wherein the detachable fastener is a zipper.

* * * * *